US008745902B2

(12) United States Patent
Wood et al.

(10) Patent No.: US 8,745,902 B2
(45) Date of Patent: Jun. 10, 2014

(54) DEVICE AND METHOD FOR TRIMMING THE ICE IN A CURLING RINK

(75) Inventors: William W. Wood, Lombardy (CA); Cynthia J. Kortebein, Knoxville, TN (US)

(73) Assignee: Guspro Inc., Chatham, Ontario (CA)

( * ) Notice: Subject to any disclaimer, the term of this patent is extended or adjusted under 35 U.S.C. 154(b) by 230 days.

(21) Appl. No.: 13/478,895

(22) Filed: May 23, 2012

(65) Prior Publication Data

US 2012/0297648 A1 Nov. 29, 2012

Related U.S. Application Data

(60) Provisional application No. 61/490,262, filed on May 26, 2011.

(51) Int. Cl.
*E01H 4/00* (2006.01)

(52) U.S. Cl.
USPC ..... 37/219

(58) Field of Classification Search
USPC ..... 37/196, 197, 219–221, 214, 268, 270; 172/449, 445.1, 501, 503, 684.5, 777, 172/448; 294/24
See application file for complete search history.

(56) References Cited

U.S. PATENT DOCUMENTS

| | | | | |
|---|---|---|---|---|
| 3,591,236 | A * | 7/1971 | Jones | 299/24 |
| 4,317,298 | A * | 3/1982 | Mathers | 37/219 |
| 4,705,320 | A * | 11/1987 | Zamboni | 299/24 |
| 5,133,139 | A * | 7/1992 | Rzechula | 37/219 |
| 6,138,387 | A * | 10/2000 | Fox et al. | 37/219 |
| 6,467,552 | B1 * | 10/2002 | Whatmough | 172/445.1 |
| 7,698,837 | B2 * | 4/2010 | Seely | 37/219 |

* cited by examiner

*Primary Examiner* — Robert Pezzuto
(74) *Attorney, Agent, or Firm* — Camoriano & Associates

(57) ABSTRACT

A device for trimming the high points off of the ice of a curling rink includes an elongated blade mounted to an elongated mounting block, and a plurality of setscrews threaded into threaded openings in the mounting block for adjusting the flatness of the blade, enabling a long blade to be used that is both accurate and relatively inexpensive.

5 Claims, 9 Drawing Sheets

DEVICE AND METHOD FOR TRIMMING THE ICE IN A CURLING RINK

This application claims priority from U.S. Provisional Application Ser. No. 61/490,262, filed May 26, 2011.

BACKGROUND

The present invention relates to a device and method for trimming off the high spots in the pebble of the ice in a curling rink.

Curling is a sport in which players slide stones across a sheet of ice towards a target area. The condition of the ice is very important. The surface of the ice is treated both to obtain a specified degree of flatness and to obtain a surface texture referred to as pebbling.

The ice flatness specification for curling ice is +/−0.001"/5 ft. When pebble is applied to the ice sheet, the water droplets (pebble) do not freeze to a uniform height. Due to the contact area of the stone, the pebble that is higher will get crushed or smashed by the stone passing over top, causing the stone to run slower on the ice sheet. Trimming off the high spots of the pebble results in a uniform pebble with a clean surface, causing the stone to run at a uniform and constant speed. Adjustment of the angle of the blade on the trimming device determines how much of the pebble is trimmed off. A typical specification requires that two ounces of ice be removed from the pebble in treating a ten-foot-wide swath along the 145 foot length of the curling rink.

SUMMARY

An embodiment of the present invention provides a device for trimming off the high points of the pebble of the ice using a single, long blade. A single blade facilitates the uniform adjustment of the angle of the blade compared to adjusting the three or four shorter blades present in prior art devices. However, the use of a single blade creates problems in maintaining the flatness of the blade over such a long length without requiring a much thicker and heavier blade, which has to be machined to very tight tolerances.

One embodiment of the present invention uses a plurality of paired sets of setscrews to adjust the flatness of the blade.

DESCRIPTION

Figure 1:
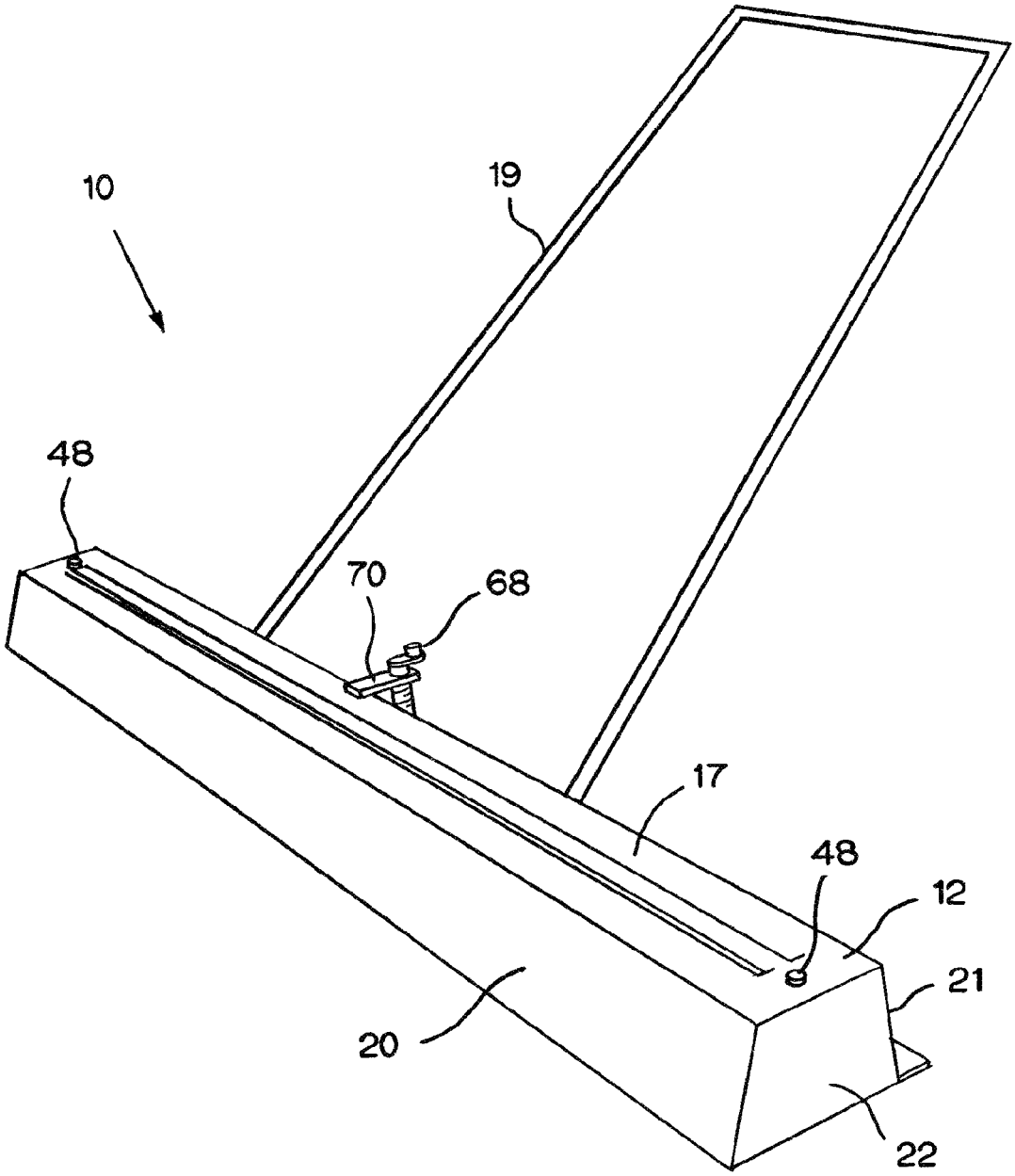
FIG. 1 is a perspective view of a device for trimming off the high spots of a curling rink.

FIGS. 1-9 show a device 10 for trimming the high spots off of a sheet of ice. The device 10 includes a substantially rectangular frame 12 which houses a blade 14, a mounting block 16, and pivot angle blocks 18 at the left and right ends of the mounting block 16, as described in more detail later. The frame 12 includes a top cover 17, a front cover 20, a rear cover 21, and left and right end covers 22. A handle 19 is attached to the rear cover 21 of the frame 12 and extends rearwardly and upwardly from the frame 12, for use by the operator to push the device 10 across the ice rink.

Figure 2:
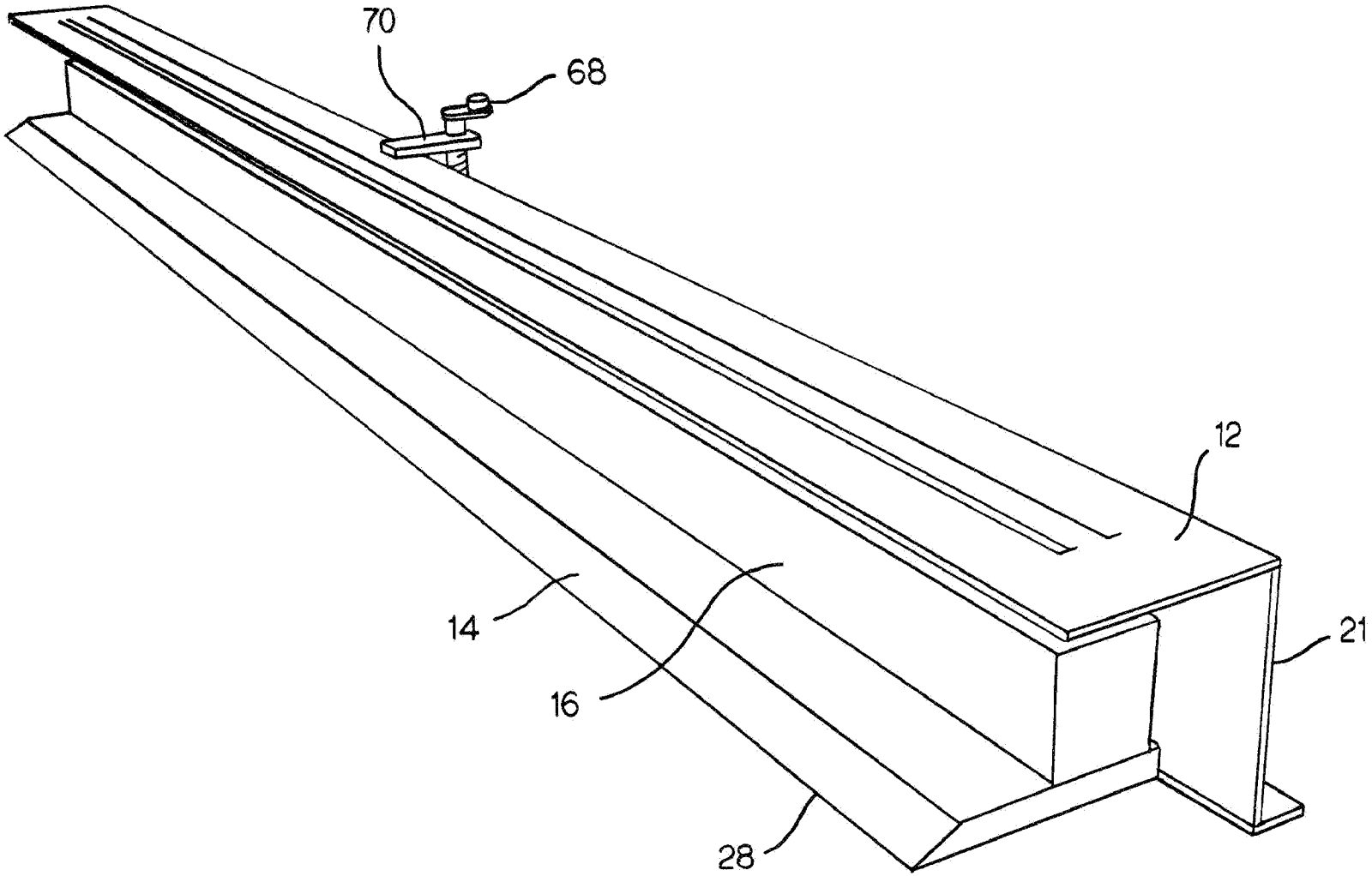
FIG. 2 is a perspective view of the frame, mounting block, and blade of the device of FIG. 1, with the front and side covers of the frame removed for clarity.

FIG. 2 shows the blade 14 and the mounting block 16 in their relative positions inside the frame 12. The front cover 20 and the left and right side covers 22 of the frame, as well as the pivot angle blocks 18, have been removed for clarity in this view. The front cover 20 typically is hinged to the top cover 17, so it may be flipped upwardly and rearwardly to gain access to the blade area to inspect the condition of the blade and to enable the user to collect and weigh the shaved ice resting on the blade 28 to determine whether the blade angle needs to be adjusted.

Figure 3:
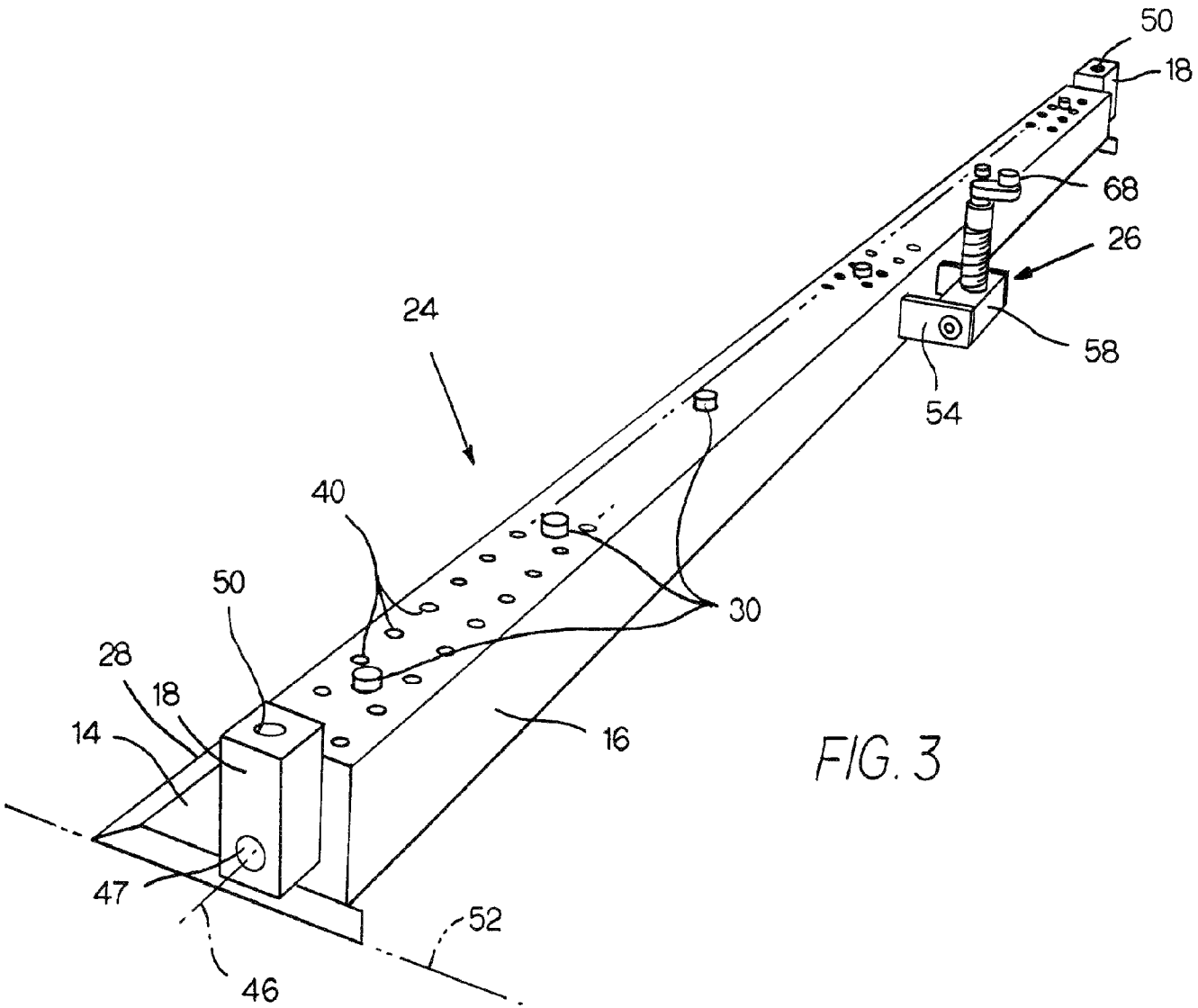
FIG. 3 is a rear, perspective view of the mounting block and blade of FIG. 2, including the pivot blocks.

FIG. 3 shows the floating blade assembly 24, which includes the blade 14, the mounting block 16, the pivot angle blocks 18, and the blade angle adjustment mechanism 26, described in more detail later. The blade 14 is a substantially flat, rectangular cross-section member with flat, horizontal top and bottom surfaces and a beveled edge 28 for scraping the ice. As explained later, in this embodiment, the blade 14 is five feet long and is bolted onto the bottom of the mounting block 16 via half-inch diameter bolts 30 (See FIGS. 4-6) spaced at approximately 6-inch intervals along the length of the blade 14.

Figure 4:
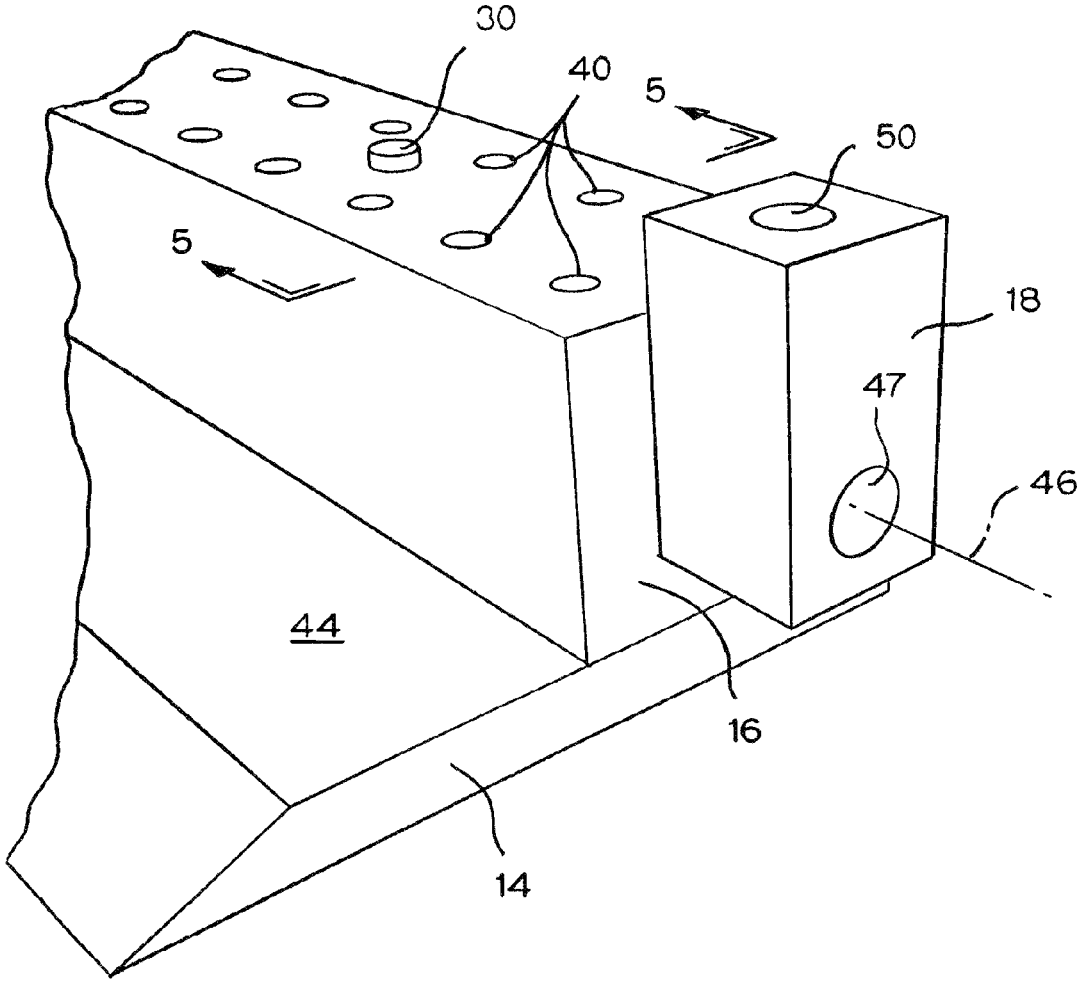
FIG. 4 is an enlarged, broken away, perspective view of the mounting block, blade, and pivot block of FIG. 3.
Figure 5:
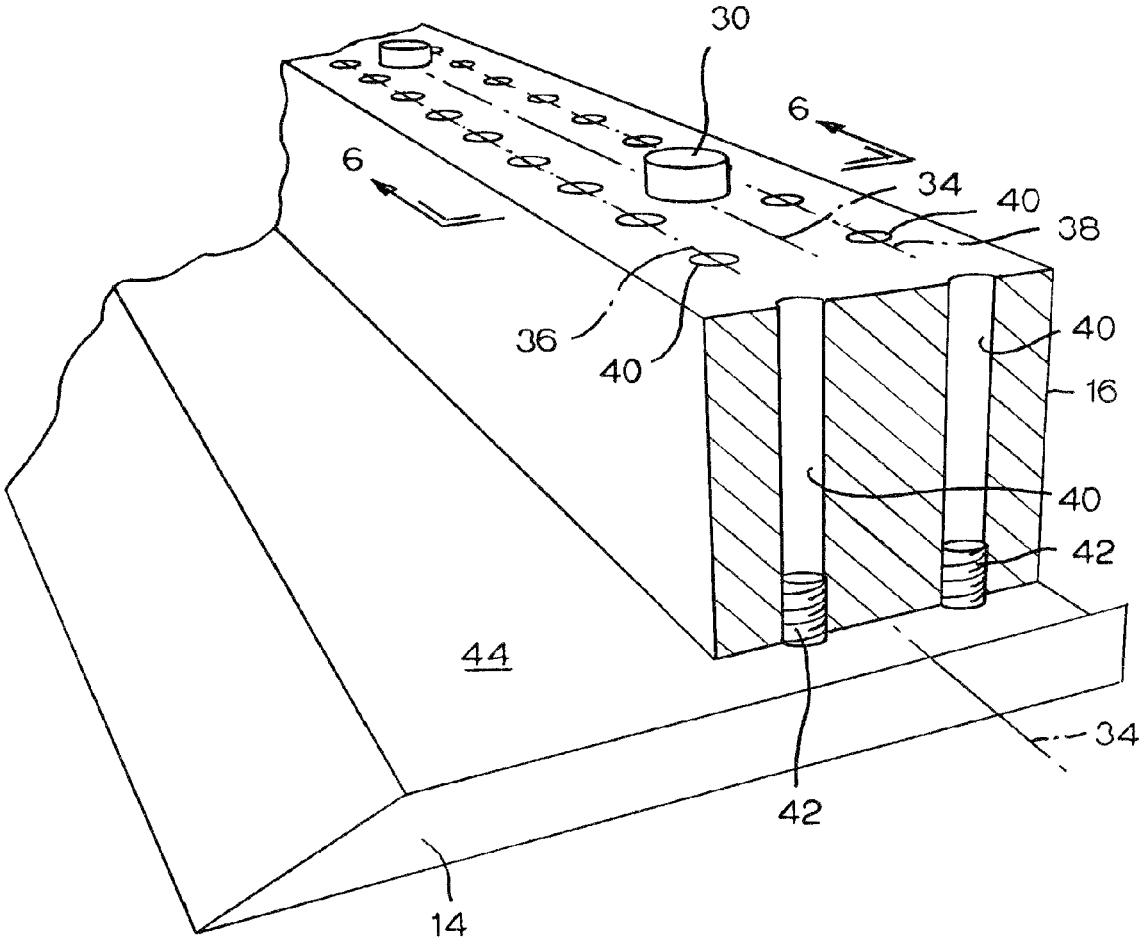
FIG. 5 is an end view of the blade, with the mounting block shown in a section taken along the line 5-5 of FIG. 4.
Figure 6:
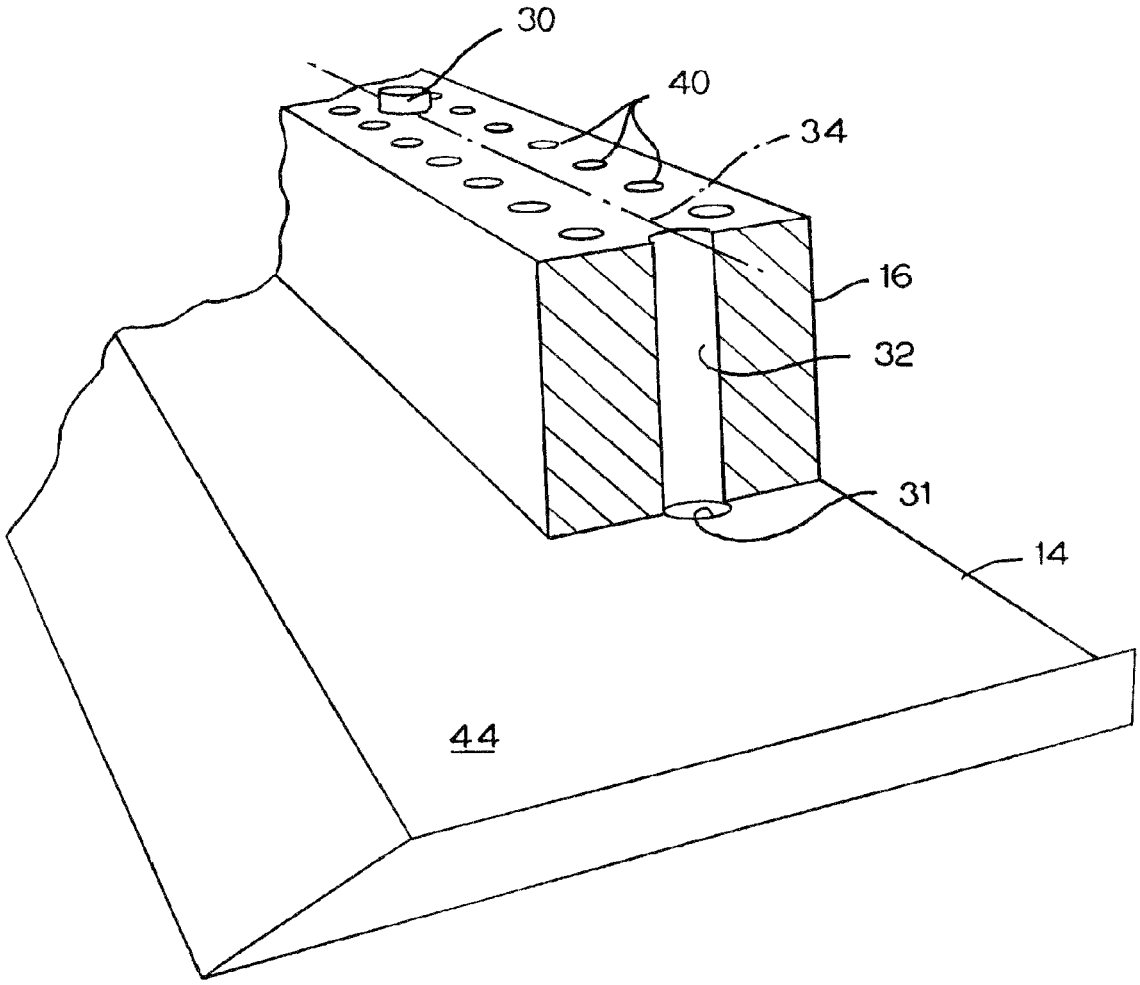
FIG. 6 is another end view of the blade, with the mounting block shown in section taken along line 6-6 of FIG. 5.

Referring to FIGS. 4-6, the mounting block 16 is a 2 inch×2 inch square cross-section metal block, approximately five feet long, which supports the blade 14. The mounting block 16 has flat, horizontal top and bottom surfaces and defines a plurality of vertically-oriented, half-inch diameter through bolt holes 32 (See FIG. 6) for securing the blade 14 to the bottom of the mounting block 16 via bolts 30 and corresponding threaded openings 31 in the blade 14. The bolt holes 32 are aligned substantially along the longitudinal centerline 34 of the mounting block 16. As explained later with respect to the flatness adjustment of the blade 14, this centerline 34 (when projected along the plane where the mounting block 16 meets the blade 14) acts as a pivot axis for the blade 14 relative to the mounting block 16.

Referring to FIG. 5, the mounting block 16 defines a plurality of ¼ inch diameter, vertically-oriented, internally threaded set-screw holes 40. Each set-screw hole 40 receives an externally threaded set screw 42. Note that there are no corresponding openings in the blade 14 to match up with the set-screw holes 40 in the mounting block 16. Therefore, the set screws 42 impinge directly upon the top surface 44 of the blade 14 when they are threaded beyond the bottom surface of the mounting block 16.

The set-screw holes 40 (and thus also the set screws 42) are substantially paired up opposite each other, with the forward set screw of each pair centered on a forward set screw centerline 36 (See FIG. 5) and the rear set screw of each pair centered on a rear set screw centerline 38. The vertical axes of the forward set screws lie along a forward vertical plane which is perpendicular to the centerline 36, and the vertical axes of the rear set screws lie along a rear vertical plane which is perpendicular to the centerline 38. The centerlines 34, 36, 38 are parallel to each other, and the first set screw centerline 36 is the same distance forward of the bolt hole centerline 34

(toward the beveled edge 28 of the blade 14) as the second set screw centerline 38 is rearward of the bolt hole centerline 34. The vertical axes of each pair of forward and rear set screw holes 40 preferably lie on a vertical plane that is perpendicular to the forward and rear vertical planes.

In this embodiment, the set screws 42 are located at approximately one inch intervals along their respective centerlines 36, 38. It should be noted that, while the arrangement shown in this embodiment is preferred, the set screws 42 could be arranged differently, such as diagonally across from each other in a triangular pitch arrangement, for instance.

To adjust the blade 14 for flatness, the blade 14 is first mounted to the mounting block 16 via the ½ inch bolts 30, with the flat top surface 44 of the blade 14 abutting the flat bottom surface of the mounting block 16. The set screws 42 are then threaded into the set-screw holes 40 until they just bottom out on the top surface 44 of the blade 14. The blade and mounting block assembly is then placed atop a master straight-edge, which is a block having a very flat top surface, and a light is placed behind the back of the assembly directing its light toward the front. A person standing in front of the blade 14 then can look for light shining through between the front of the blade 14 and the master straight edge to detect any gaps between the blade 14 and the master straight-edge, indicating that the blade 14 is not flat. To close a gap between the blade 14 and the master straight-edge (which brings the blade into flat condition), the front set screw 42 lying closest to the location where the gap is found is threaded against the top surface 44 of the blade 14, pushing downwardly against the top surface 44 of the blade 14 forward of the bolt centerline 34 and causing that portion of the blade 14 to pivot downwardly about the bolt centerline 34 relative to the mounting block 16. Since there is approximately a four (4) inch distance between the beveled edge 28 and the bolt centerline 34, a very small downward movement of the top surface 44 of the blade 14 caused by the forward set screw 42 results in a significant downward movement of the beveled edge 28 to close the gap and bring the blade 14 to a flat condition at the longitudinal position corresponding to that particular set screw 42.

If, during the flatness adjustment, the blade 14 is actually pushed too far down, then the person making the adjustment backs off the front set screw 42 at the longitudinal position corresponding to the location where the blade 14 is too far down. The opposing rear set screw 42 lying along the rear centerline 38 then may be threaded further down to push downwardly on the blade 14 rearward of the bolt centerline 34 in order to correct the problem and bring the blade 14 back to the desired flatness.

Essentially, the blade 14 is pivoted very slightly about the bolt centerline 34 by threading in one or more set screws 42 along the front set-screw centerline 36 (and backing off the corresponding set screws 42 along the rear set-screw centerline 38) to lower the beveled edge 28 of the blade 14 to bring the blade 14 into the desired degree of flatness. If the blade 14 is already too low (or if the above adjustment over-corrected the problem), the procedure is reversed; that is, the blade 14 is pivoted very slightly about the bolt centerline 34 by threading in one or more set screws 42 along the rear set-screw centerline 38 (and backing off the corresponding set screws 42 along the front set-screw centerline 36) to raise the beveled edge 28 of the blade 14.

This flatness adjustment is intended to move the beveled edge 28 of the blade 14 just a few thousandths of an inch and to do so at very localized points along the length of the blade 14 to bring the blade 14 to the desired degree of flatness. A different adjustment for setting the angle of blade 14 will be described later.

Figure 9:
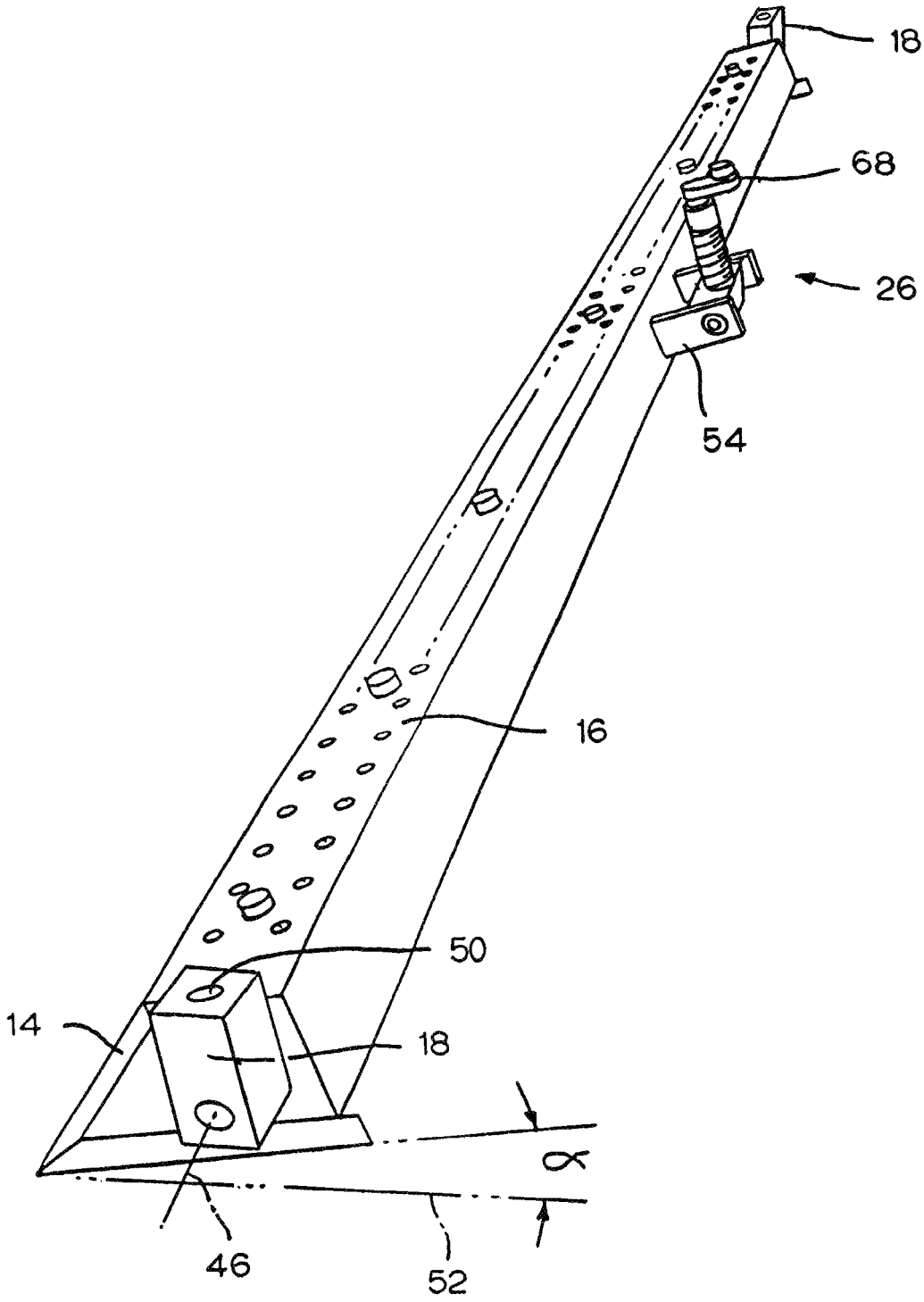
FIG. 9 is a perspective view of the blade, mounting block, and pivot block of FIG. 3, but shown with the blade and mounting block pitched forward relative to the pivot block.

Referring now to FIGS. 3 and 4, the floating blade assembly 24 includes pivot angle blocks 18 at each end of the mounting block 16. These pivot angle blocks 18 are mounted to the mounting block 16 by means of circular cross-section pins 47, which permit pivotal rotation of the mounting block 16 relative to the pivot angle blocks 18 about an axis of rotation 46, as best shown in FIG. 9. The pivot angle blocks 18 are mounted to the frame 12 via bolts 48 (See FIG. 1) which are threaded into bolt holes 50 in the pivot angle blocks 18, so the pivot angle blocks 18 are stationary relative to the frame 12.

The frame 12 rests on top of the ice, and the pivot angle blocks 18 are securely attached to the frame 12, so they are not allowed to move relative to the frame 12. However, the floating blade assembly 24 is pivotably mounted to the pivot angle blocks 18 such that the blade 14 may be moved from a first position in which its bottom surface is substantially coplanar with the surface of the ice 52 (See FIG. 3), to a second position (See FIG. 9) wherein the bottom surface of the blade 14 is at an angle $\alpha$ relative to the surface of the ice 52. This angle $\alpha$ is shown exaggerated in FIG. 9. In the usual practice, the angle $\alpha$ would likely be adjusted to a maximum angle on the order of two to four degrees. The blade angle adjustment mechanism 26 is used to obtain and retain this relatively small angle $\alpha$, as described below.

Figure 7:
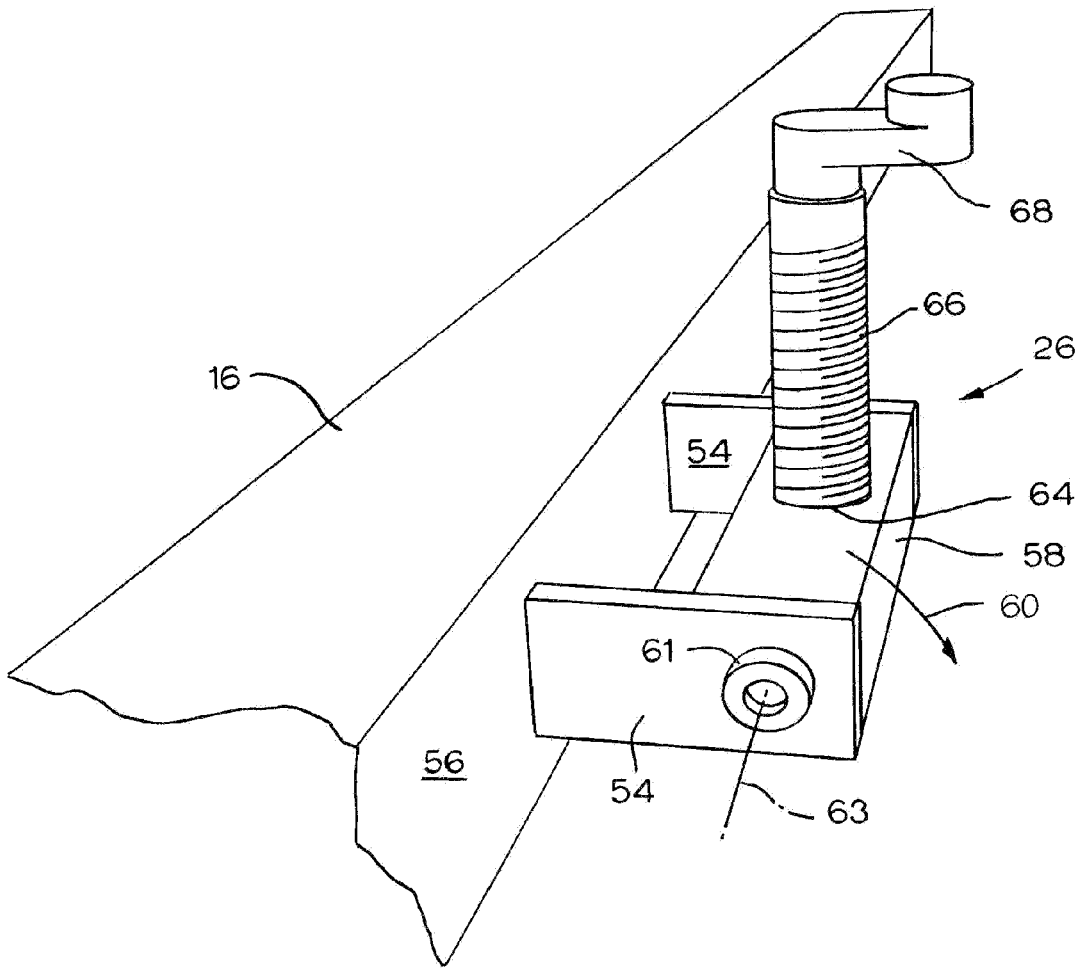
FIG. 7 is an enlarged, broken away, perspective view of the mounting block and angle adjustment mechanism of FIG. 3.
Figure 8:
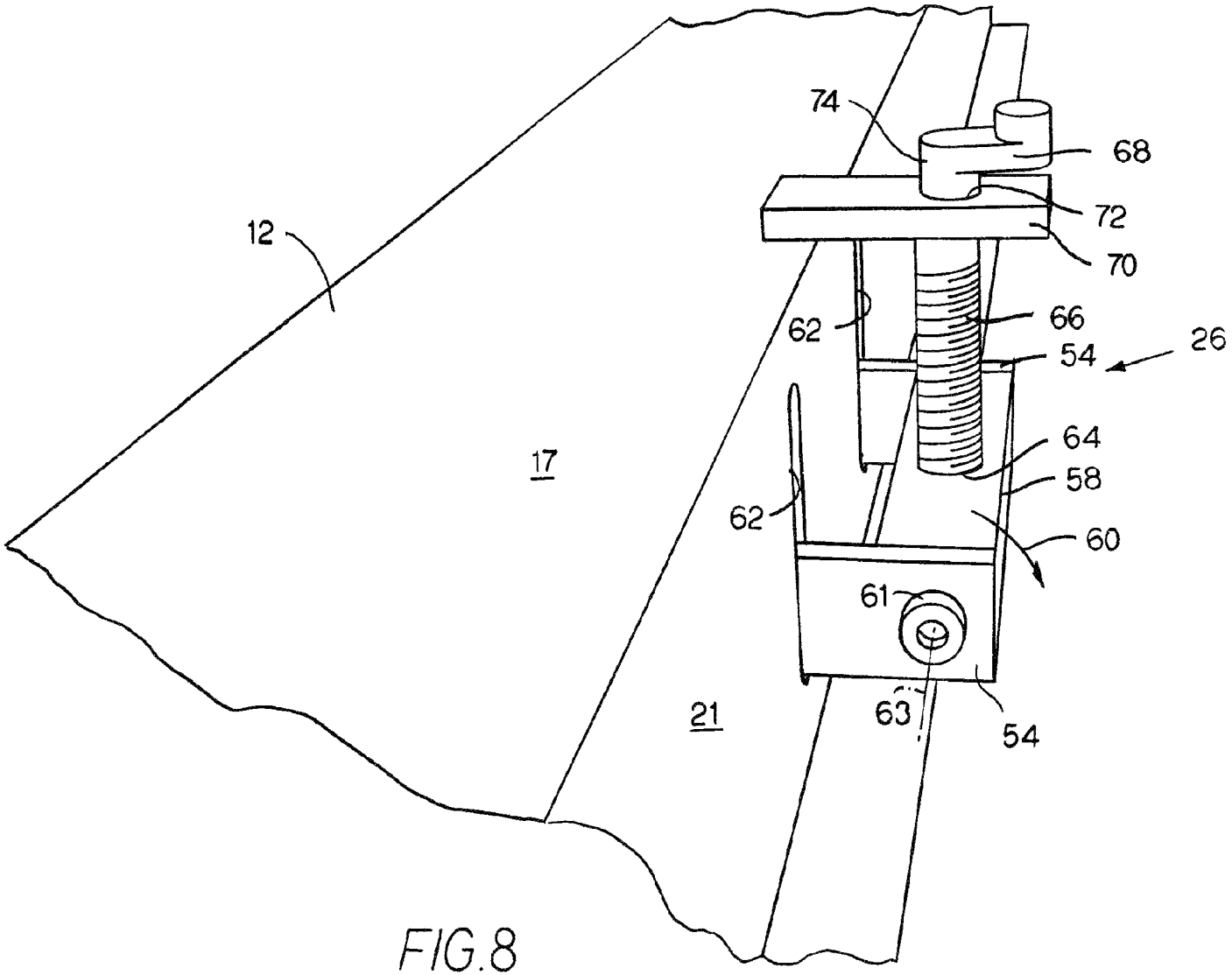
FIG. 8 is an enlarged, broken away perspective view of the angle adjustment mechanism of FIG. 7, but with the frame installed (essentially a rear view of FIG. 2)

Referring to FIGS. 7 and 8, the blade angle adjustment mechanism 26 includes two spaced-apart brackets 54 which are secured to the rear face 56 of the mounting block 16. In this embodiment, the brackets 54 are welded to the mounting block 16, but other known mounting means, such as bolting, could be used. A piece of bar stock 58 is pivotably mounted between the ends of these two brackets 54 by means of pins 61, such that the bar stock 58 may pivot about the pivot axis 63 as shown by the arrow 60. The bar stock 58 is releasably secured to the brackets 54 so that the frame 12 may be mounted over the floating blade assembly 24, with the brackets 54 projecting through slots 62 in the rear cover 21 of the frame 12, as best shown in FIG. 8, prior to full assembly of the blade angle adjustment mechanism 26.

The bar stock 58 defines a threaded vertical opening 64 which receives the threaded shaft 66 of the hand crank 68. The threads in the threaded opening 64 and in the matching shaft 66 of the hand crank 68 are fine threads such that one complete turn of the hand crank 68 results in a very small amount of thread advance. This allows very fine adjustment of the angle of the blade 14 as explained below.

Referring to FIGS. 1 and 8, a bracket 70 is secured to the frame 12. In this embodiment, the bracket 70 is welded to the top cover 17 of the frame 12. This bracket 70 defines a top opening 72 adapted to receive and rotationally support the hand crank 68. The threaded shaft 66 of the hand crank 68 passes through the top opening 72, but the head 74 of the hand crank 68 is too large to go through the top opening 72. The weight of the bar stock 60 causes the head 74 of the hand crank to rest on the top surface of the bracket 70, so that the hand crank 68 and the threaded shaft 66 are fixed-height supported on the frame 12 by the bracket 70. Therefore, as the hand crank 68 is rotated by the operator, the threaded shaft 66 also rotates and threads into the threaded opening 64 of the bar stock 58, pulling the bar stock 58 upwardly toward the bracket 70. The bar stock 58 pivots slightly in the direction of the arrow 60 as it is drawn up towards the bracket 70 in order to keep the shaft 66 aligned with the threaded opening in the bar stock 58 to prevent it from locking up as the blade angle is being adjusted.

Since the lower brackets 54 are secured to the rear surface 56 of the mounting block 16, as the bar stock 58 and the lower brackets 54 are drawn up toward the upper bracket 70, the floating blade assembly 24 is tipped forward, pivoting on the pivot angle blocks 18, as shown in FIG. 9. System friction prevents the hand crank 68 from moving and holds the blade 14 at the desired angle α once the operator has set the angle.

To adjust the angle α, the operator turns the hand crank 68 to a first setting. He then pushes the device 10 along the full 145 foot length of the curling ice rink. In this embodiment, the blade 14 is approximately 5 feet long, so a 5 foot swath of ice is trimmed by the device 10 in a single pass. The operator then takes a second pass along the length of the ice rink to make a total swath width of 10 feet. He then opens up the front cover 20 of the frame 12 and collects any ice which has accumulated on the blade 14.

The operator weighs the amount of ice collected and compares this weight to the desired weight of two ounces. If more than two ounces were collected, he turns the hand crank 68 in a counter-clockwise direction to reduce the angle α of the blade 14. If less than two ounces were collected, he turns the hand crank 68 in a clockwise direction to increase the angle α of the blade 14. This process is repeated until the amount of ice collected is within the desired tolerance of the two ounce goal. The ice rink may then be re-pebbled and the entire ice surface trimmed to the specification.

It will be obvious to those skilled in the art that modifications may be made to the embodiment described above without departing from the scope of the present invention.

What is claimed is:

1. A mounting arrangement for a device for trimming the high points off of ice on an ice rink, comprising:

an elongated blade having a left end and a right end and defining a blade length extending from said left end to said right end; said elongated blade also having a flat top surface, a flat bottom surface, and a beveled forward edge and defining a first set of vertically-oriented, threaded openings extending through said top surface and located at spaced-apart positions along a first bolt centerline extending in the left-to-right direction;

a mounting block having a flat bottom surface and defining a block length and a second set of vertically-oriented openings which lie along a second bolt centerline and are aligned with the first set of threaded openings in the blade;

a plurality of bolts, each of said bolts extending through one of the openings in said second set of openings and threading into a respective one of the openings in said first set of threaded openings to secure said blade to said block;

a plurality of vertically-oriented first set-screw openings through said block, said first set-screw openings being threaded and being spaced-apart from each other and lying along a first set-screw centerline parallel to the first bolt centerline; and a plurality of first set screws received in said first set-screw openings, wherein, when the first set screws are threaded downwardly beyond the bottom surface of the mounting block, the first set screws press against the top surface of the blade.

2. A mounting arrangement for a device for trimming the high points off of ice on an ice rink as recited in claim 1, wherein said plurality of vertically-oriented first set-screw openings are spaced apart at short intervals, and the second set of vertically-oriented openings are spaced apart from each other at much larger distances than said short intervals, so there are several times more of said first set screw openings than there are of second vertically-oriented openings.

3. A mounting arrangement for a device for trimming the high points off of ice on an ice rink as recited in claim 2, and further comprising:

a plurality of vertically-oriented second set-screw openings through said block, said second set-screw openings being threaded and being spaced-apart from each other at short intervals and lying along a second set-screw centerline parallel to the second bolt centerline, wherein the first set-screw centerline is forward of the second bolt centerline a first distance, and the second set-screw centerline is rearward of the second bolt centerline a second distance which is equal to the first distance; and a plurality of second set screws received in said second set-screw openings, wherein, when the second set screws are threaded downwardly beyond the bottom surface of the mounting block, the second set screws press against the top surface of the blade.

4. A mounting arrangement for a device for trimming the high points off of ice on an ice rink as recited in claim 3, wherein the first set-screw centerline lies rearward of said beveled edge.

5. A method for mounting a blade on a device for trimming the high points off of ice on an ice rink, comprising the steps of:

providing an elongated blade having a left end and a right end, and defining a blade length from said left end to said right end, said blade also having a flat top surface, a flat bottom surface, and a beveled forward edge and defining a first set of vertically-oriented, threaded openings extending through said top surface and located at spaced-apart positions along a first elongated bolt centerline;

providing an elongated mounting block having a flat bottom surface and defining a block length;

bolting said block to said blade through a second set of vertically-oriented openings which are aligned with the first set of threaded openings in the blade; said block defining a plurality of vertically-oriented first set-screw openings through said block, said first set-screw openings being threaded and being spaced-apart from each other and lying along a first set-screw centerline parallel to the first bolt centerline;

threading a plurality of first set screws into said first set-screw openings, wherein, when the first set screws are threaded downwardly beyond the bottom surface of the mounting block, the first set screws press against the top surface of the blade;

placing said blade atop a master straight-edge;

shining a light to detect a gap between the master straight-edge and the blade; and threading in at least one of said plurality of set crews near the detected gap to press against the top surface of the blade to close the gap.

* * * * *